US006255629B1

(12) United States Patent
Supper et al.

(10) Patent No.: US 6,255,629 B1
(45) Date of Patent: Jul. 3, 2001

(54) DEVICE FOR SWITCHING AN ELECTRIC HEATER

(75) Inventors: Bernd Supper, Kornwestheim; Reiner Staeble, Oberderdingen, both of (DE)

(73) Assignee: E.G.O. Elektro-Geratebau GmbH (DE)

( * ) Notice: Subject to any disclaimer, the term of this patent is extended or adjusted under 35 U.S.C. 154(b) by 0 days.

(21) Appl. No.: 09/384,501

(22) Filed: Aug. 27, 1999

(30) Foreign Application Priority Data

Aug. 28, 1998 (DE) ..... 198 39 265

(51) Int. Cl.[7] ..... H05B 1/02

(52) U.S. Cl. ..... 219/483; 219/486; 219/501; 219/508; 307/38

(58) Field of Search ..... 219/483–486, 219/507–510, 494, 466, 497, 462.1, 505, 451–453; 307/117, 38–41

(56) References Cited

U.S. PATENT DOCUMENTS

| | | | | |
|---|---|---|---|---|
| 4,538,051 | * | 8/1985 | Schreder et al. | 219/466 |
| 4,740,664 | | 4/1988 | Payne . | |
| 4,849,701 | * | 7/1989 | Saatkamp et al. | 224/549 |
| 5,866,879 | | 2/1999 | Higgins . | |
| 5,948,303 | * | 9/1999 | Larson | 219/486 |
| 6,018,149 | * | 1/2000 | Higgins | 219/462.1 |
| 6,118,106 | | 9/2000 | Scott . | |

FOREIGN PATENT DOCUMENTS

| | | |
|---|---|---|
| 295 19 021 | 2/1996 | (DE) . |
| 44 45 558 | 6/1996 | (DE) . |
| 195 14 261 | 8/1996 | (DE) . |
| 196 45 907 | 5/1998 | (DE) . |
| 197 06 188 | 8/1998 | (DE) . |
| 0 719 072 | 6/1996 | (EP) . |
| 0 729 292 | 8/1996 | (EP) . |
| 0 788 292 | 8/1997 | (EP) . |
| 0 892 584 | 1/1999 | (EP) . |

* cited by examiner

*Primary Examiner*—Mark Paschall
(74) *Attorney, Agent, or Firm*—Akerman Senterfitt

(57) ABSTRACT

The invention provides a device (11) for switching an electric heater (12) with at least two heating areas (25, 27, 29), which can be variably supplied with electric power by at least one power setter (22) and having control means (19) for the at least one power setter (22, 23) and with functionally separate switching means (14, 16) for operating the at least one power setter. On operating a first switching means (14), a heating area (27) associated therewith can be set by means of a power setter via the control means and on operating a further switching means (16) a heating area (29) associated therewith is settable by means of a power setter. Preferably, precisely one heating area (27, 29) is associated with each switching means (14, 16). The heating areas can be areally extensive heating zones or different power levels of a heater.

15 Claims, 1 Drawing Sheet

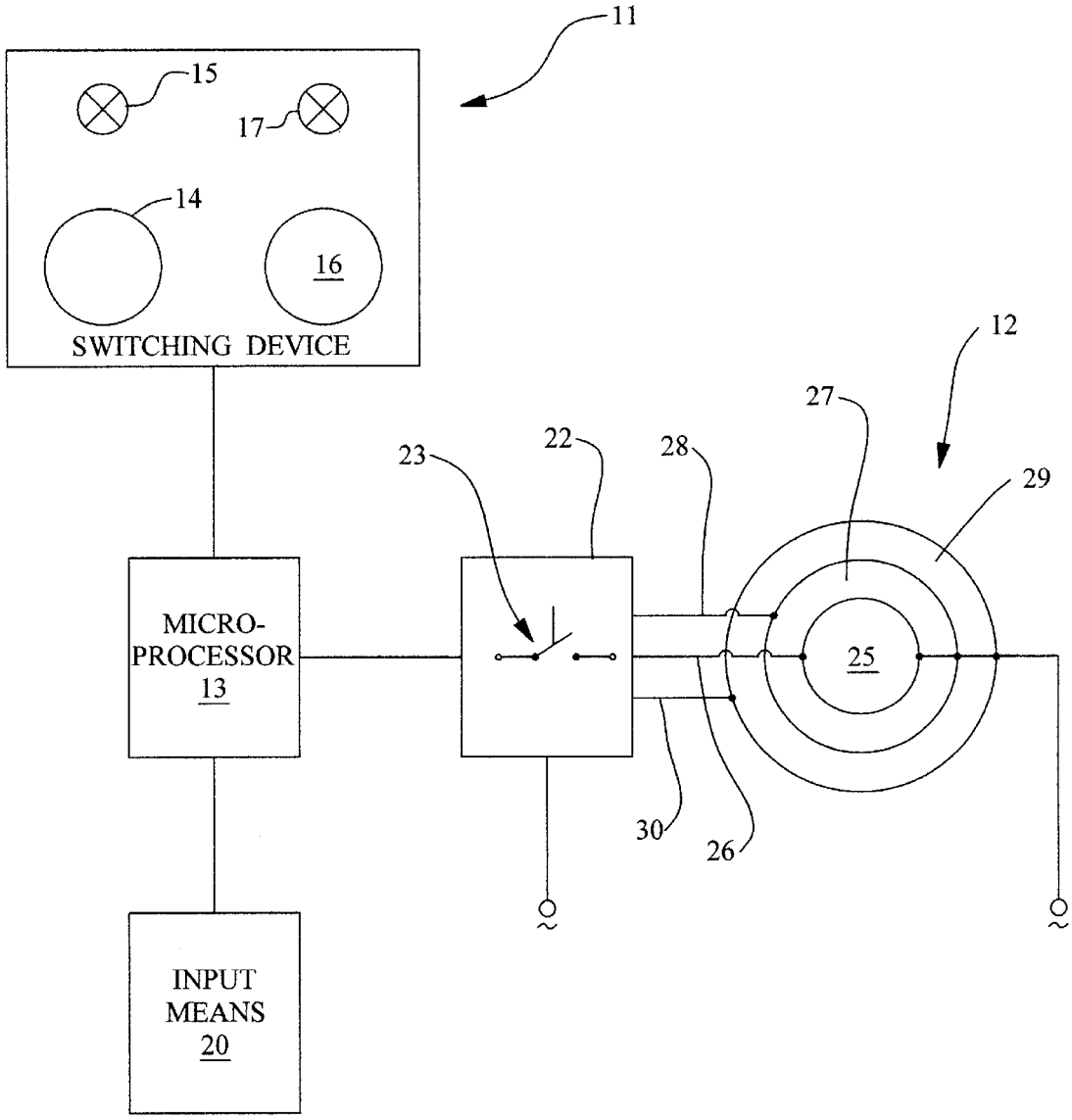
11
15
17
14
16
SWITCHING DEVICE
12
27
22
28
23
29
MICRO-
PROCESSOR
13
25
30
26
INPUT
MEANS
20

DEVICE FOR SWITCHING AN ELECTRIC HEATER

FIELD OF USE AND PRIOR ART

The invention relates to a device for switching an electric heater having at least two heating areas, which can be variably supplied with electric power by means of at least one power regulator or setter, with control means for the at least one power regulator or setter and with functionally separated switching means for operating the at least one power regulator or setter by means of the control means. Preferably such a device is used in electric heating appliances, particularly for the home.

Devices are known in which there are two switching means for switching on or off a heater. One of the two switches serves as a so-called release switch, following the operation of which and within a given time interval the second switch must be operated. As a result of the operation of the second switch, the heater is switched on. By again operating the first switch, the heater can be switched off again. A similar procedure is proposed for switching on several heating areas of a heater. One switch is a release switch, whilst with a second switch it is possible to successively and continuously switch on the different heating areas.

PROBLEM AND SOLUTION

The problem of the invention is to provide a device permitting a rapid and simple switching of various heating areas in accordance with the wishes of a user, which is universally usable, reliable and simple to manufacture.

This problem is solved by claim 1. If the control means during the operation of a first switching means set a heating area associated therewith by means of at least one power setter and on operating a further switching means can set a heating area associated therewith by means of at least one power setter, it is possible to directly set the heating areas without a need for multiple operation. Preferably, precisely one heating area is associated via the control means with each switching means. A setting preferably takes place by power setters, particularly in each case one associated power setter. In this way it is possible with only a single operation of a switching means to directly set a desired heating area, which reduces both effort and possible incorrect operations. Preferably, the control means sets the heating area on the first operation of a switching means for said heating area.

According to a further development of the invention, in the case of a further or second operation of the same switching means, the control means switch off part of the heating areas, preferably all the switched on heating areas. Preferably, between the two operations, there is no intermediate change to the electric power supply to the heating areas and/or operation of one of the switching means. If another heating area was set, now the new heating area corresponding to the operated switching means is set.

The switching means and/or heating areas are preferably hierarchically subdivided and in particular it is advantageous to have a subdivision from low to high. Alternatively other subdivisions are possible, although the aforementioned is preferred.

In one operating procedure, on operating a switching means of a heating area in a higher step or level than the instantaneously set step or level, the control means can rise to said step or level. Levels below it can be switched off, but preferably the control means also set the levels below it. This means that through an operation of a specific switching means, its heating area and all the heating areas below it can be set or switched on.

On operating a switching means of a heating area of a lower level than the instantaneously set level, the control means can reset to this lower level. It is also considered advantageous to switch off levels above it but, in accordance with what was stated hereinbefore, can also remain set.

In a preferred application of the invention, particularly in the case of domestic electric heating appliances such as electric cookers, the heating areas can be spatially or areally extensive heating zones. In particular, as additional heating zones they are associated with a basic heating zone of the heater and are preferably adjacent to the basic heating zone. The basic heating zone can be substantially surrounded by the additional heating zones, either by each additional heating zone or several or even all of the latter.

A possible hierarchic arrangement of the heating areas in different levels can correspond to the spatial association of the additional heating zones with respect to the basic heating zone. In one possibility the additional heating zones rise in steps as a function of their size and preferably an increasing distance from the basic heating zone is used as a basis for the rise.

In a performance possibility of the invention the heater can have a basic heating zone arranged in a circular hotplate of an electric cooker, the additional heating zones forming an enlargement of the heatable surface, preferably being adjacent on one side as an extension and/or substantially surrounding the basic heating zone. This is e.g. possible with an electric cooker having four hotplates, including a concentrically larger, heatable circular area for particularly large cooking vessels and laterally facing additional heating zones for baking devices or the like.

A link between the heating of the heater and the heating areas can be that a power supplied to at least one of the additional heating zones is adapted to a power supply to the basic heating zone. Thus, it is possible in the above case, with a basic heating zone set to a given cooking power, the additional heating zones can be supplied with the latter on setting.

As an alternative to additional heating zones, the heating areas can be different power levels of the heater. The power levels are in particular arranged in rising manner, preferably from 0 to maximum. An embodiment of this inventive aspect would e.g. be a heater with a stepwise adjustable power and a plurality of switching means, to each of which corresponds a power stage or level. A setting of the desired power level takes place by operating the particular switching means and not with a rotary toggle, as e.g. occurs in known electric cookers.

With each switching means can be associated indicating or display means, preferably in spatial proximity to the switching means. The control means can activate the display means of the in each case set heating area and preferably only the display means of said heating area. The display means of further, optionally set heating areas of said heater are preferably not set. The display means are preferably constituted by an optical display or indicator, e.g. an illuminated display, preferably with bulbs or in particularly preferred manner with light emitting diodes.

As switching means are suitable touch switches, preferably having a capacitive basis. They are preferably installed under a cover, e.g. a glass ceramic hotplate. Particular preference is given to contact switches with a spatially extensive, inherently flexible sensor body, which is shapevariable. Touch switches of this type are e.g. described in German patent application 197 06 168.0.

The power setters can be constituted by mechanical switches, preferably electromechanical switches, power relays being e.g. suitable.

The control means can have a microprocessor, which is preferably connected to a memory for operating states and/or parameters or contains the same. In this case the switching means supply a signal initiating a switching process. The microprocessor can take over further functions. It is also possible to associate with the switching means further functions, e.g. for a change in the configuration of the entire device or an electric heating appliance.

These and further features can be gathered from the claims, description and drawings and the individual features, either singly or in the form of subcombinations, can be implemented in an embodiment of the invention and in other fields and can represent advantageous, protectable constructions for which protection is hereby claimed. The subdivision of the application into individual sections and the subtitles in no way limit the general validity of the statements made thereunder.

BRIEF DESCRIPTION OF THE DRAWING

An embodiment of the invention is described hereinafter relative to the single diagrammatic drawing of a device for switching a heater with several heating zones by means of a microprocessor connected to two touch switches.

DETAILED DESCRIPTION OF THE EMBODIMENT

The drawing shows a switching device 11 according to the invention for switching an electric heating device 12, which can e.g. be a radiant heater of a glass ceramic hotplate. The switching device 11 has as switching means a touch switch 14 and a further touch switch 16. With the first touch switch 14 is associated an optical signal indicator or display 15, whilst a second signal indicator or display 17 is associated with the second touch switch 16.

The diagrammatically shown heating device 12 has a basic heating zone 25, a first additional heating zone 27 and a second additional heating zone 29. In the represented embodiment the additional heating zones 27, 29 roughly concentrically surround the basic heating zone 25. However, it is also possible to adopt constructions in which the additional heating zones are laterally linked with a basic heating zone. Combinations of surrounding and laterally connected additional heating zones are also possible. The shape of the heating zones is not restricted to substantially circular constructions.

The first and second touch switches 14 and 16 are connected to control means in the form of a microprocessor 19, as are the indicators 15 and 17. The microprocessor 19 is also connected to input means 10, which in the represented embodiment set the level of the electric power supplied to the heating device 12.

The microprocessor 19 is connected to a power regulator or setter 22, which comprises several switching units 23. Each of the two additional heating zones 27, 29 has its own switching unit 23, with which it is connected by means of a first additional connection 28 and a second additional connection 30. The basic heating zone 25 is connected by a connection 26 to its own switching unit 23.

The switching units 23 of the power setter 22 can be constructed in such a way that the same adjustable power level can be supplied to all the heating zones of the heating device 12. For this purpose the switching units 23 of the first and second additional heating zones 27 and 29 are e.g. constructed as simple on/off switches, whereas the switching unit 23 of the basic heating zone 25 determines the power level for the complete heating device 12. It can e.g. be constructed as a timing power control device. It is alternatively possible to construct all the switching units 23 as such timing power control devices, so as to be able to in this way individually set the power level of all the heating zones 25, 27 and 29.

Thus, the drawing shows a heating device 12 with three heating areas. On removing the basic heating zone 25 and the input means 20, there is a heating device settable by means of the touch switches 14 and 16 and having the two heating zones 27 and 29. The switching on or off of the heating zones takes place in the above-described manner. Using separate input means it is possible to determine the level of the power supply of the in each case set heating zones 27 or 29. In the case of a heating device with e.g. five additional heating zones there would be five touch switches.

As a function of the heating device 12 the switching units 23 can be differently constructed, e.g. as electromechanical switches or power relays. Particularly for induction heaters power electronics components can be used.

FUNCTION

An advantageous functional sequence in an exemplified use in a hot point of an electric cooker made possible by the invention can take place in the following way. A certain power level of the basic heating zone 25 is set by the input means 20. If the size of a cooking vessel placed on the heating device 12 significantly exceeds the size of the basic heating zone 25, the additional heating zones 27 and/or 29 are required. If a user operates the first touch switch 14, the first optical signal indicator 15 lights up and the microprocessor 19 actuates the switching unit 23 of the first additional heating zone 27. By means of the additional connection 28, the latter, like the basic heating zone 25, is connected to a power supply and have the same power level. Thus, the heated surface area of the heating device 12 is considerably increased.

If the once extended heating surface of the heating device 12 is not large enough for a cooking vessel, by means of the second touch switch 16 and in the same way using the microprocessor 19 and the associated switching unit 23 the second additional heating zone 29 can be switched on. Thus, there is a synchronization of all three heating zones 25, 27 and 29 of the heating device 12. The microprocessor 19 switches on the second optical signal indicator 17 and preferably switches off again the first optical signal indicator 15.

If, directly and in addition to the basic heating zone 25, the second touch switch 16 is operated, then the microprocessor 19 sets the first additional heating zone 27 and second additional heating zone 29. The second signal indicator 17 lights up. This makes it clear that by operating in each case one touch switch directly the associated switching state of the heating device 12 is set, without it being necessary to approach it in individual operating stages.

If with the two additional heating zones 27 and 29 switched on, the second touch switch 16 is operated, the microprocessor 19 switches off both additional heating zones, both signal indicators 15 and 17 go out and only the basic heating zone 25 remains switched on. However, if from the aforementioned state, the first touch switch 14 is operated, then switching takes place to the state corresponding to said switch, which means that all the higher additional beating zones, in this case the additional heating zone 29, are switched off. The signal indicator 17 goes out and signal indicator 15 lights up. Renewed operation of the first touch switch 14 also switches off the first additional heating zone 27.

ALTERNATIVE EMBODIMENT

According to the invention the heating areas can not only be the above-described heating zones as an extension of a heating device, but also different power levels, in particular of a single heater. Much as described hereinbefore, by operating the corresponding switching means or touch switches a heating or power level can be set in place of areal heating zones. On conceiving the heating device 12 as a single heater and the heating zones 25, 27 and 29 e.g. as levels I, II and III, i.e. rising power levels, the above-described operating diagram can be directly used, so that no further explanations are needed.

What is claimed is:

1. A device for switching an electric heater, said electric heater having at least three spatially extensive and neighboring heating areas, wherein a basic heating zone of said heater is associated with at least two additional heating zones, said device comprising:

at least one power setter for variably supplying said heating areas with electric power;

control means for said at least one power setter; and functionally separate switching means for the operation of said at least one power setter via said control means;

wherein precisely one of said heating areas is associated with one of said switching means via said control means;

wherein the heating area associated with a first one of the switching means is switched on by means of at least one of said power setters, during operation of said first switching means; and wherein the heating area associated with further switching means is switched on by means of at least one of said power setters, during operation of said further switching means.

2. The device according to claim 1, wherein on the first operation of one of said switching means, said control means directly sets the heating area associated with said switching means.

3. The device according to claim 1, wherein on a subsequent operation of one of said switching means without any change to the power supply of the heating areas and/or the operating of one of the switching means during an interval between the first operation and the subsequent operation, said control means switches off all of said heating areas.

4. The device according to claim 1, wherein said switching means and/or heating areas are hierarchically subdivided.

5. The device according to claim 4, wherein said switching means and/or heating areas are subdivided in levels from low to high.

6. The device according to claim 4, wherein on operating a switching means of a heating area of a higher level than the presently set level, said control means sets said level.

7. The device according to claim 6, wherein said control means set said level and all levels below it.

8. The device according to claim 6, wherein on operating a switching means of a heating area of a lower level than the instantaneously set level, said control means reset to said lower level and switch off levels above it.

9. The device according to claim 1, wherein a hierarchic arrangement of said heating areas in levels corresponds to the spatial association of said additional heating zones to said basic heating zone.

10. The device according to claim 9, wherein said levels rise from low to high with increasing distance from said basic heating zone.

11. The device according to claim 9, wherein said heater has a basic heating zone located in a circular hotplate of an electric cooker and said additional heating zones form an enlargement of the heatable surface area, being adjacent as an extension on one side and/or substantially surrounding said basic heating zone.

12. The device according to claim 9, wherein a power level supplied to one of said additional heating zones is adapted to a power supply of said basic heating zone.

13. The device according to claim 1, wherein with each switching means are associated indicating or display means, said control means activating said indicating means of the in each case set heating area.

14. The device according to claim 1, wherein said switching means are touch switches with a capacitive basis, said switching means being fitted under a cover.

15. The device according to claim 1, wherein said control means have a microprocessor with which is associated a memory for operating states and/or parameters.

* * * * *